US012276487B2

(12) United States Patent
Gilbert

(10) Patent No.: US 12,276,487 B2
(45) Date of Patent: Apr. 15, 2025

(54) TOOLS FOR APPLYING TORQUE

(71) Applicant: COUNTERMEASURE SYSTEMS LIMITED, Norfolk (GB)

(72) Inventor: Robert Jackson Gilbert, Norfolk (GB)

(73) Assignee: COUNTERMEASURE SYSTEMS LIMITED, Norfolk (GB)

( * ) Notice: Subject to any disclaimer, the term of this patent is extended or adjusted under 35 U.S.C. 154(b) by 512 days.

(21) Appl. No.: 17/846,280

(22) Filed: Jun. 22, 2022

(65) Prior Publication Data

US 2023/0099819 A1 Mar. 30, 2023

(30) Foreign Application Priority Data

Jun. 23, 2021 (GB) ..... 2109026

(51) Int. Cl.
*F42B 33/06* (2006.01)
*F42B 3/00* (2006.01)

(52) U.S. Cl.
CPC ..... *F42B 33/06* (2013.01); *F42B 3/006* (2013.01)

(58) Field of Classification Search
CPC ..... B25B 11/02; B25B 27/0085; B25B 27/14; B25B 29/00; B25B 33/00; F42B 3/006; F42B 3/22; Y10T 29/53687; Y10T 29/53717; Y10T 29/53839; Y10T 29/53843; Y10T 29/54
See application file for complete search history.

(56) References Cited

U.S. PATENT DOCUMENTS 3,234,727 A * 2/1966 Filer ..... F42B 3/006 29/523
7,997,179 B1 * 8/2011 Nelson ..... F42B 33/062 89/1.701
10,928,173 B1 2/2021 Foltz et al.
2010/0307152 A1 * 12/2010 Mayer ..... F15B 15/19 60/632

FOREIGN PATENT DOCUMENTS

CN 206450143 U * 8/2017
CN 109282713 A 1/2019
DE 8910886 U1 11/1989

* cited by examiner

*Primary Examiner* — Tyrone V Hall, Jr.
(74) *Attorney, Agent, or Firm* — SZDC Law PC

(57) ABSTRACT

Disclosed is a tool for applying torque to an object, the tool comprising: a frame for clamping to the object to which torque is to be applied, the frame comprising a pair of jaws with an adjustable separation therebetween, and an adjuster mechanism to adjust the separation between the jaws; at least one thruster disposed on opposite sides of an intended axis of rotation of the frame, respective thrusters providing thrust in opposite directions, so as to cooperate and generate torque on the frame; characterised in that a displaceable mass is provided within a barrel extending from at least one of said thrusters, which mass is displaced by the thruster upon actuation, so as to increase the recoil, and hence the torque, experienced by the frame upon actuation of the thruster.

18 Claims, 3 Drawing Sheets

TOOLS FOR APPLYING TORQUE

This application claims priority to United Kingdom Patent Application No. GB 2109026.1, filed on Jun. 23, 2021, which is incorporated by reference for all purposes as if fully set forth herein.

FIELD OF THE INVENTION

This invention relates to a tool for applying torque, a system comprising the tool, and a method of applying torque using the tool or system of the invention.

BACKGROUND OF THE INVENTION

A known device for applying torque is the "Rocket Wrench", commercially available from Richmond Defence Systems Ltd. This tool is intended for unscrewing the tail or nose fuse of an unexploded bomb. The rocket wrench comprises a frame provided with a pair of adjustable jaws, which can be clamped to the tail or nose fuse, with a rocket tube and associated venturi disposed on opposite sides of the frame and pointing in opposite directions. The thrust delivered by each of the rocket tubes and venturi is generated by a blank power cartridge, which can be remotely electrically initiated from a safe distance. When actuated, the device creates a "Catherine wheel" effect, rotating (anticlockwise) so as to unscrew the tail or nose fuse of the bomb.

The torque generated by the Rocket Wrench is sufficient to unscrew the fuse of an unexploded bomb which is relatively new or in good condition. However, it is often necessary to remove the fuses from bombs which are old or in poor condition. For example, unexploded bombs dating from the Second World War are often found when excavating land, or in canals, especially in Germany and the Netherlands. These have been buried for decades in damp ground or lying underwater. The resulting corrosion can make the fuses rusty and very difficult to unscrew, and the inventor has found that the known rocket wrench is unable to provide sufficient torque to unscrew the fuses in such circumstances.

The present invention aims to overcome or ameliorate this problem.

SUMMARY OF THE INVENTION

In a first aspect the invention provides a tool for applying torque to an object, the tool comprising: a frame for clamping to the object to which torque is to be applied, the frame comprising a pair of jaws with an adjustable separation therebetween, and an adjuster mechanism to adjust the separation between the jaws; at least one thruster disposed on opposite sides of an intended axis of rotation of the frame, respective thrusters providing thrust in opposite directions, so as to cooperate and generate torque on the frame; characterised in that a displaceable mass is provided within a barrel extending from at least one of said thrusters, which mass is displaced by the thruster upon actuation, so as to increase the recoil, and hence the torque, experienced by the frame upon actuation of the thruster.

In a typical embodiment, the frame is provided with two thrusters, said thrusters being disposed on opposite sides of the intended axis of rotation of the frame. In another embodiment, the frame is provided with four thrusters, with one pair of thrusters being disposed on opposite sides of the intended axis of rotation of the frame. This latter embodiment provides even further increased torque. In theory, three or more thrusters may be provided on each side of the frame, although increasing numbers of thrusters increases the overall dimensions of the device and increases the amount of ground clearance required to be able to use the device and often this is not feasible because of the location/situation of the bomb or other munition.

Conveniently each thruster comprises a charge of propellant, explosive or the like. Typically the charge is initiated electrically, (generally by means of an electrically-initiated primer charge, ignition of which detonates the propellant charge) and desirably remotely initiated from a safe distance. In a simple embodiment, the thruster comprises a blank cartridge, with an electrically initiated primer, the propellant in the cartridge serving as a suitable charge to provide thrust. Typically a .50 cal blank cartridge is suitable for this purpose.

It will be apparent that the displaceable mass is advantageously ejected from the barrel by the actuation of the charge, the movement of the mass rearwardly from the barrel providing recoil in the forward direction, enhancing the torque experienced by the frame and hence on the object (such as a bomb fuse) to which the frame is clamped. The displaceable mass conveniently comprises a piston within the bore of the barrel. In a preferred embodiment the piston is formed from a material which is selected and shaped so as to have a substantially gas-tight seal with the interior surface of the barrel once the propellant charge has been initiated. Specifically, the piston advantageously undergoes a deformation when the charge is initiated, the force on the piston exerted by the initiation of the charge tending to cause the piston to deform in such a way as to cause the piston to create a gas-tight seal with the interior surface of the barrel. Preferably the piston substantially comprises or consists of a synthetic plastics material, especially a moulded plastics material. The inventor has found that high-density polyethylene (HDPE) is especially preferred for the piston material. Prior to detonation of the propellant charge, the piston may conveniently be of a size and shape that it may be relatively freely slidably movable within the barrel.

The displaceable mass will preferably have a mass of at least 1 gm, more preferably at least 2 gms, and desirably will have a total mass in the range 2 to 20 gms. Not all of the displaceable mass will necessarily be attributable to the piston, as explained below.

In a preferred embodiment, the tool further comprises a resistance which tends to resist the displacement of the displaceable mass. More specifically, it is preferred that the tool comprises a resistance which tends to resist the displacement of a displaceable piston. Conveniently the resistance is provided in the barrel "downstream" of the piston. The resistance may be provided by a gas but, more preferably, is provided by a liquid, since liquids are far less compressible than gases, and are denser and thus contribute more towards the displaceable mass. The liquid may conveniently be water or an aqueous mixture. For use on land, in order to retain a liquid within the barrel, prior to initiation of the charge, it is advantageous to provide a closure or stopper at the downstream end of the barrel. This may conveniently be, for example, a simple screw cap, which is screwed onto the end of the barrel. The cap may desirably comprise or substantially consist of a synthetic plastics material such as polycarbonate, PTFE or similar plastics polymer. The closure or stopper may be ruptured or forcibly ejected from the end of the barrel in consequence of the force generated by the detonation of the propellant charge. In other circumstances (e.g. removing the fuse from a bomb underwater), there may be no need for a cap, and the barrel can simply be allowed to flood with water from the external environment.

The barrel is typically substantially circular in cross-section and conveniently wholly or predominantly formed from metal, such as steel or alloys comprising steel. In a typical embodiment the barrel has a length in the range of about 40-100 mm, and has a bore in the range of about 20-40 mm diameter. An end of the thruster is desirably provided with a screw thread on its external surface, such that the proximal end of the barrel, provided with a co-operating thread, can be engaged with the thruster.

The frame, adjustable jaws, and the adjuster mechanism for adjusting the separation between the jaws, may all be largely conventional and essentially as already known from the existing rocket wrench device. These components will typically be formed wholly or substantially from metal, such as steel or alloys comprising steel. The adjuster mechanism may conveniently utilise a screw threaded engagement, such that rotation of a wheel, cog or the like causes relative movement of the jaws towards or away from one another, depending on the direction of rotation of the wheel, cog or the like.

The inventor has identified that the invention confers a number of advantages over the existing known rocket wrench device. These include: in the known rocket wrench device a high proportion of the propellant charge is vented, unburnt, through the venturi at the end of the thruster. This is inefficient and means that substantially less torque is created than is theoretically possible for a given size of charge. In contrast, in the device of the present invention, the barrel extending from the thruster, with the piston situated within the bore of the barrel, creates a larger chamber (at least momentarily, immediately following initiation of the charge) beyond the venturi of the thruster, permitting more complete combustion of the propellant charge, increasing efficiency and thrust. Also: displacement of the displaceable mass (e.g. piston and liquid within the barrel) creates increased recoil and therefore increased torque. Once the displaceable mass has been displaced from the barrel, the residual burning propellant/gaseous products of combustion exit the barrel to preserve a "rocket" effect.

In a second aspect the invention provides a system for applying torque to an object, the system comprising a tool in accordance with the first aspect defined above, together with one or more of the following: a plurality of single-use caps for capping the distal end of the barrel; and a plurality of single-use deformable pistons. By way of explanation, it will be apparent from the foregoing that, in at least some embodiments, the piston is deformable and is deformed by detonation of the propellant charge, such that the piston may be a consumable item, which is discarded after a single-use. Equally, the end caps covering the barrel may be ruptured or destroyed after the charge is detonated, and are consumable items which are unusable after a single use. Accordingly, it is convenient to provide the tool of the first aspect of the invention as a system, in combination with one or more of one, or both, of these consumable items.

In a third aspect the invention provides a method for applying torque to an object, the method comprising the steps of:

a) adjusting the separation between the jaws of a device in accordance with the first aspect of the invention defined above, by means of the adjuster mechanism, so as to clamp the device to the object;

b) placing a cap over the distal end of the barrel; and c) causing the initiation of the thrusters.

The method may additionally comprise the step of introducing a piston into the bore of the barrel. If the method is performed on land, the method may also comprise the step of introducing a fluid, preferably a liquid, typically water, into the barrel downstream of the piston. It will be apparent to those skilled in the art that the steps of introducing a piston, and introducing a fluid into the barrel, are conveniently performed before performing step (b). If the method of the invention is performed under water, then it is preferred that the piston is introduced into the barrel before the barrel is submerged under the water, and there is no necessity for step (b).

In a preferred embodiment, the piston fits snugly (but not in a gas-tight manner) upon insertion into the barrel—this facilitates the piston being introduced reasonably readily without requiring exertion of undue force. However, once the propellant charge has been detonated, the expanding gases created by the detonation distort the thin proximal edges of the piston and force them outwards into a gas-tight seal with the interior surface of the barrel, preventing dissipation of the thrust.

As will be apparent from the foregoing, the object to which torque is to be applied will normally be the tail or nose fuse of an unexploded bomb, and in preferred embodiments, the method of the invention forms a step in a method of de-fusing an unexploded bomb, but in principle the device and method of the invention can be used to apply torque to other objects.

The invention will now be further described by way of illustrative embodiments and with reference to the accompanying drawing figures in which.

EXAMPLES

Example 1

Description of the Prior Art

Figure 1B:
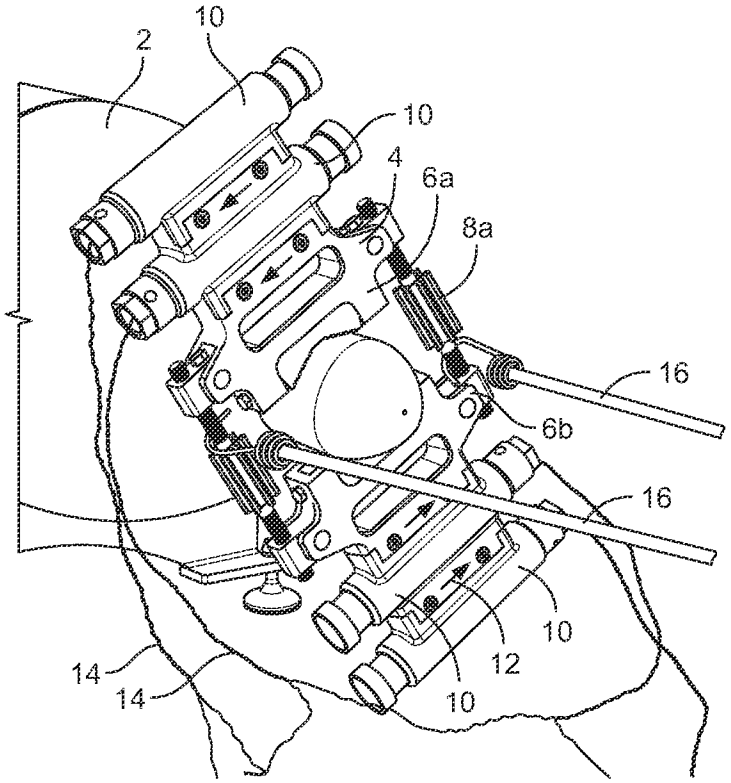
FIGS. 1A and 1B show two different embodiments of prior art known "rocket wrench" devices in situ attached to the nose fuse of an unexploded bomb.
Figure 1A:
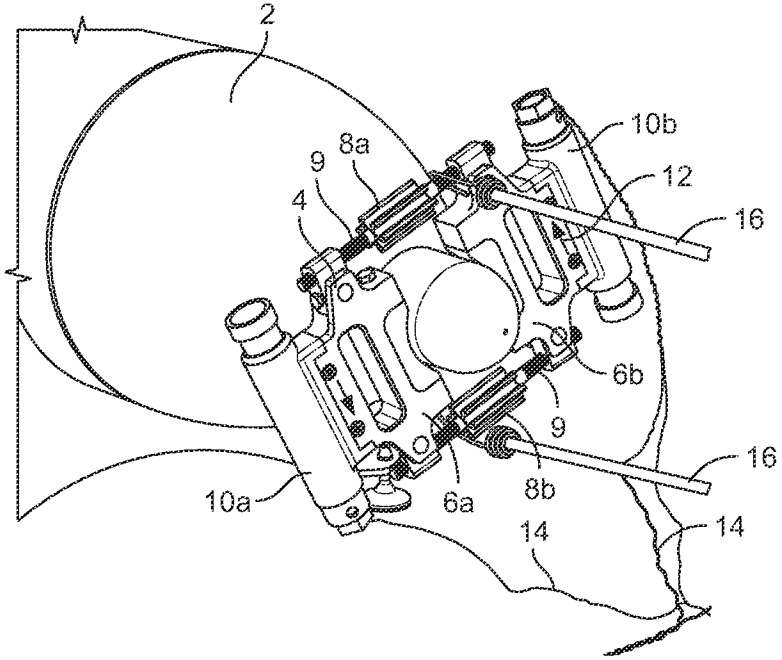

Referring to FIG. 1A, there is shown a conventional prior art "rocket wrench" device clamped to the nose fuse of an unexploded bomb (2). The rocket wrench device comprises a steel frame (4), provided with a pair of jaws (6*a*, 6*b*). The separation between the jaws (6, 6*a*) can be adjusted by means of an adjuster mechanism comprising a pair of knurled wheels (8*a*, 8*b*), each wheel mounted on a respective shaft (9) which is in screw-threaded engagement with an end region of each of the jaws (6*a*, 6*b*). A pair of thrusters (10*a*, 10*b*) is also provided on the frame, located at the outer edge thereof (so as to maximise turning moment on the frame). The thrusters (10*a*, 10*b*) take the form of a rocket tube (comprising a propellant charge) and a venturi. One thruster (10*a*, 10*b*) is provided on each side of the axis of intended rotation of the frame, with thrusters (10*a*, 10*b*) pointing in opposite directions, so as to cooperate and provide torque on the frame when the thrusters are actuated. The direction of rotation of the frame is indicated by the arrows (12) marked thereon. It will be noted that the direction of rotation is anticlockwise, so as to cause the fuse to be unscrewed from the bomb (2). Wires (14) are visible which are to permit the electrical initiation of the propellant charge in the thrusters (10*a*, 10*b*) to be performed remotely from a safe distance. Finally, bungee cords 16 are attached to the frame to allow the fuse to be withdrawn from the bomb, again from a safe distance, once the fuse has been unscrewed.

FIG. 1B illustrates a similar prior art "rocket wrench" device but, in this embodiment, the frame is provided with four thrusters 10, with one pair of thrusters being provided on each side of the frame.

Example 2

Detailed Description of an Embodiment of the Invention

Figure 2:
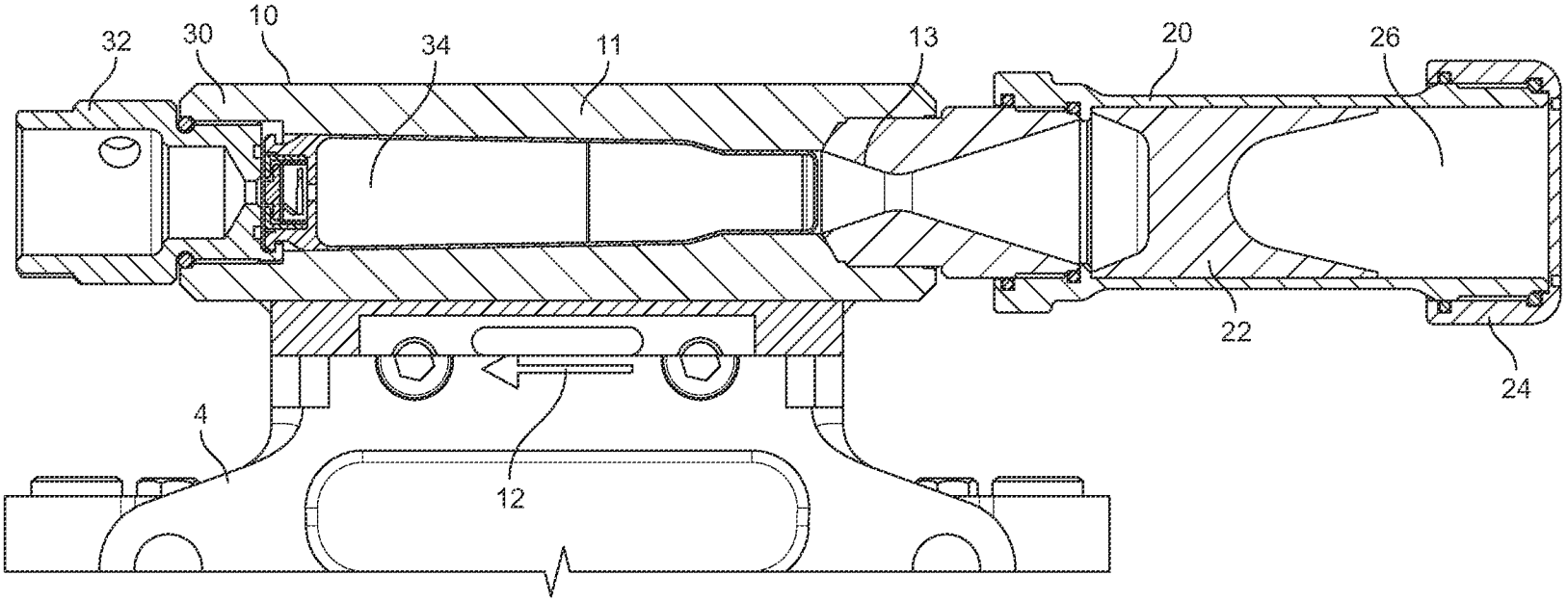
FIG. 2 shows a sectional view of part of one embodiment of a device in accordance with the invention.

FIG. 2 is a sectional view of part of an embodiment of a device in accordance with the present invention. Parts of the device are similar to the prior art device shown in FIG. 1A, and like components are denoted by common reference numerals. The device comprises a steel frame 4, part of which is apparent in the Figure. The frame 4 is provided with a pair of adjustable jaws, (not shown in FIG. 2), by which the frame can be clamped onto the tail or nose fuse of a bomb or other object to which torque is to be applied. The separation between the adjustable jaws can be altered using an adjuster mechanism, which comprises a pair of knurled wheels, each of which is mounted on a respective shaft, which is in screw-threaded engagement with an end region of each of the jaws, generally as illustrated in FIGS. 1A, 1B. This allows both the relative angle, and the separation, between the jaws to be altered.

As with the prior art device, a pair of thrusters is also provided on the frame, located at the outer edge thereof (so as to maximise turning moment on the frame). One such thruster, 10, is shown in FIG. 2. The thrusters 10 comprise a rocket tube 11 and a venturi 13. The rocket tube includes a breech 30, which is sealed at a proximal end thereof by breech plug 32. Within the breech is a blank .50 cal cartridge 34, the propellant of which provides the thrust. The cartridge is fired by an electrical initiator which enters the device via the breech plug 32 and activates initiation means located in the base of the cartridge. In addition, each thruster also has a respective barrel 20 screwed onto the distal end of the thruster. Each barrel is made of steel and is 30 mm in diameter and about 60-80 mm long. A displaceable mass is provided within the barrel, which mass is displaced by the thruster upon actuation, so as to increase the recoil, and hence the torque, experienced by the frame upon actuation of the thruster.

In the illustrated embodiment, the displaceable mass takes the form of a piston 22 seated within the bore of the barrel. The piston is formed from a material which is selected and shaped so as to have a substantially gas-tight seal with the interior surface of the barrel once the charge has been initiated. Specifically, the piston advantageously undergoes a deformation when the charge is initiated, the force on the piston exerted by the charge tending to cause the piston to deform in such a way as to cause the piston to create a gas-tight seal with the interior surface of the barrel. In the illustrated embodiment, the piston is formed from moulded HDPE and has a concave surface facing the propellant charge. When the propellant charge is fired, the expanding gases generated tend to force the thin edges of the piston outwards, into contact with the interior surface of the barrel 20, so as to form a gas-tight seal therewith. At the distal, "downstream" end of the barrel 20 is a plastics cap 24, which is in screw-threaded engagement with, and seals the end of, of the barrel. Further, between the piston 22 and the cap 24, the interior of the barrel 20, the tool comprises a resistance 26 which tends to resist the displacement of the piston. The resistance may be provided by a gas but, more preferably, is provided by a liquid, since liquids are far less compressible than gases. Thus, in the illustrated embodiment, the interior of the barrel 20, "downstream" of the piston 22, is filled completely with water, kept in place in the barrel 20 by the piston 22 and the cap 24.

Figure 3B:
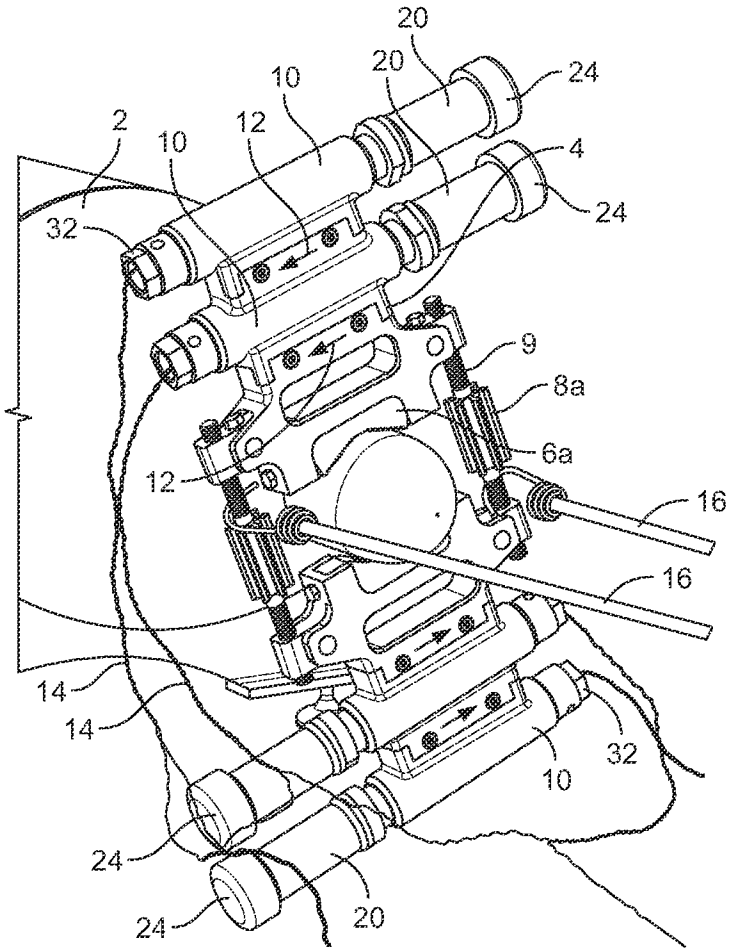
FIGS. 3A and 3B show two different embodiments of a device in accordance with the first aspect of the invention in situ, attached to the nose fuse of an unexploded bomb.
Figure 3A:
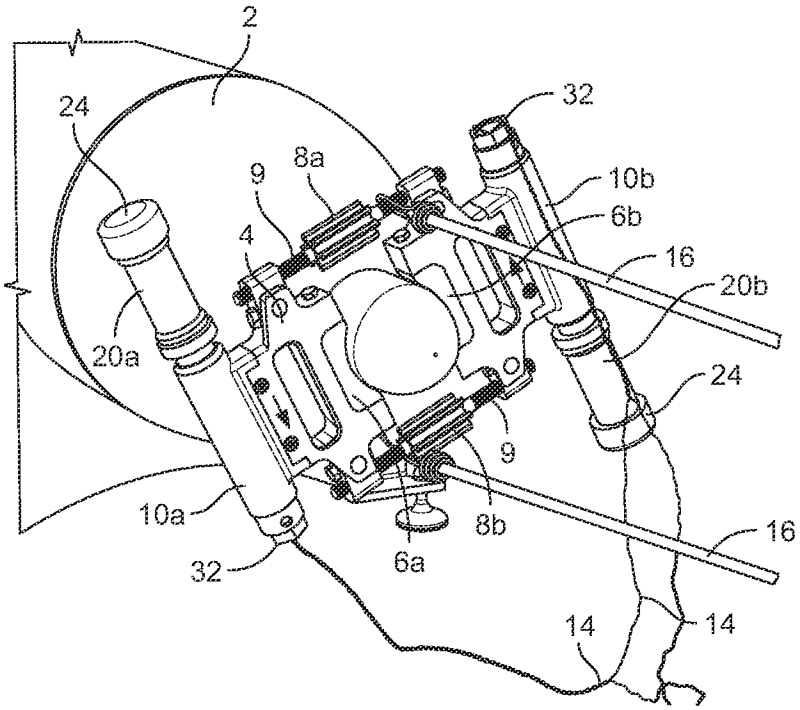

Referring to FIG. 3A, there is shown an embodiment of a device in accordance with the invention, clamped to the nose fuse of an unexploded bomb. Parts of the device are similar to the prior art device shown in FIG. 1A, and like components are denoted by common reference numerals.

Similarly, FIG. 3B shows a second embodiment of a device in accordance the invention, clamped to the nose fuse of an unexploded bomb. Parts of the device are similar to the prior art device shown in FIG. 1B, and like components are denoted by common reference numerals. The embodiment is essentially similar to that shown in FIG. 3A, but differs in that the device comprises four thrusters in total, with one pair of thrusters provided on each of the two opposed sides of the frame.

The invention claimed is:

1. A tool for applying torque to an object, the tool comprising: a frame for clamping to the object to which torque is to be applied, the frame comprising a pair of jaws with an adjustable separation therebetween, and an adjuster mechanism to adjust the separation between the jaws; at least one thruster disposed on opposite sides of an intended axis of rotation of the frame, respective thrusters providing thrust in opposite directions, so as to cooperate and generate torque on the frame; characterized in that a displaceable mass is provided within a barrel extending from at least one of said thrusters, wherein the displaceable mass is displaced by said at least one of said thrusters upon actuation, so as to increase the recoil, and hence the torque, experienced by the frame upon actuation of the thruster.

2. A tool according to claim 1, wherein each thruster comprises a charge of propellant or explosive.

3. A tool according to claim 2, wherein the charge is electrically initiated remotely.

4. A tool according to claim 1, wherein the displaceable mass comprises a piston within the bore of the barrel.

5. A tool according to claim 4, wherein the piston is formed from a material which is selected and shaped so as to have a gas-tight seal with the interior surface of the barrel once a charge of propellant or explosive has been initiated.

6. A tool according to claim 4, wherein the piston comprises a synthetic plastics material.

7. A tool according to claim 6, wherein the piston is a moulded synthetic plastic material.

8. A tool according to claim 4, wherein the piston comprises of high-density polyethylene (HDPE).

9. A tool according to claim 4, wherein the tool further comprises a resistance which resist displacement of the displaceable mass.

10. A tool according to claim 9, wherein the resistance is provided by a body of liquid, located within the barrel between the piston and an end cap covering the barrel.

11. A tool according to claim 10, wherein the liquid fills the volume of the barrel between the piston and the end cap.

12. A tool according to claim 1, wherein the displaceable mass comprises a body of liquid.

13. A tool according to claim 12, wherein the liquid is water or an aqueous solution.

14. A system for applying torque to an object, the system comprising a tool in accordance with claim 1, together with one or more of the following: a set of a plurality of single-use caps for capping the distal end of the barrel; and a set of a plurality of single-use deformable pistons.

15. A method for applying torque to an object, the method comprising the steps of:

a) adjusting the separation between the jaws of the tool in accordance with claim 1, by means of the adjuster mechanism, so as to clamp the device to the object;

b) placing a cap over the distal end of at least one barrel; and c) causing the initiation of said at least one of said thrusters.

16. A method for applying torque to an object in accordance with claim 15, the method additionally comprising the step (ai) of:

filling, with a liquid, the volume of the barrel downstream of the distal end of a piston located therein.

17. A method for applying torque to an object lying underwater, the method comprising the steps of:

a) adjusting the separation between the jaws of the tool in accordance with claim 1, by means of the adjuster mechanism, so as to clamp the device to the object;

(b) allowing the water to fill the barrel downstream of a piston; and c) causing the initiation of said at least one of said thrusters.

18. A method according to claim 15, wherein the object is a tail fuse or a nose fuse of a bomb or other munition.

* * * * *